United States Patent [19]

Mattingly et al.

[11] Patent Number: 4,629,272

[45] Date of Patent: Dec. 16, 1986

[54] ELECTRICAL CONNECTOR ASSEMBLY WITH ANTI-ROTATION LATCH MECHANISM

[75] Inventors: William R. Mattingly, Santa Ana; Roy Kroger, Norco, both of Calif.

[73] Assignee: Matrix Science Corporation, Torrance, Calif.

[21] Appl. No.: 719,937

[22] Filed: Apr. 4, 1985

[51] Int. Cl.[4] ..... H01R 13/625

[52] U.S. Cl. ..... 339/90 R; 339/DIG. 2

[58] Field of Search ..... 339/DIG. 2, 89 R, 89 C, 339/89 M, 90 R, 90 C

[56] References Cited

U.S. PATENT DOCUMENTS 4,056,298 11/1977 Cooper et al. ..... 339/90 R
4,521,066 6/1985 Kempe ..... 339/89 M
4,530,559 7/1985 Burns et al. ..... 339/DIG. 2
4,531,801 7/1985 Baur ..... 339/DIG. 2

FOREIGN PATENT DOCUMENTS 2343345 9/1977 France ..... 339/90 R
1137294 12/1968 United Kingdom ..... 339/90 R

*Primary Examiner*—John McQuade
*Attorney, Agent, or Firm*—Nilsson, Robbins, Dalgarn, Berliner, Carson & Wurst

[57] ABSTRACT

An electrical connector receptacle shell assembly and an electrical connector plug assembly are mated together to provide electrical contact between a matrix of pins and sockets. An annular drive sleeve telescoped within a coupling nut having a floating bayonet pin coupling mechanism causes the connector plug shell within the electrical plug shell assembly to move axially forward onto the receptacle shell as the coupling nut is rotated. An anti-rotation latch mechanism prevents the inadvertent misalignment of the components within the connector plug assembly, so that the connector plug shell assembly remains annularly aligned with the coupling nut until the receptacle shell and the electrical plug assembly are coupled. The latch mechanism is thereby released and the coupling nut can then rotate relative to the first shell.

7 Claims, 9 Drawing Figures

ELECTRICAL CONNECTOR ASSEMBLY WITH ANTI-ROTATION LATCH MECHANISM

FIELD OF THE INVENTION

This invention relates to an electrical connector plug shell assembly, and more particularly to an electrical connector plug shell assembly having an internal bayonet coupling system and an anti-rotation latch mechanism.

BACKGROUND OF THE INVENTION

The use of electrical connectors in the environment of an aircraft requires consideration of a number of conditions which might not otherwise require critical attention. For example, air pressure decreases from 14.7 psi at sea level to one millionth of a kilogram at an altitude of 70 miles. Temperature, humidity, solar radiation, wind, rain, temperature, shock, zero gravity, and ozone levels are just a few of the factors which must be considered when designing electrical connectors for an avionic environment. Among the most critical of such conditions are the affect of mechanical stress, vibration, electromagnetic interference (EMI) and radio frequency interference (RFI).

The walls of commercial aircraft pressurized cabins are cold relative to the heated environmental system employed to make passengers comfortable at high altitudes. Moisture forms where the walls interface the heated cabin. This moisture can run underneath the floors and condense on the electrical connector terminals located within the aircraft skin structure. The condensed moisture may cause corrosion. Cables running within the skin structure must be reliably designed since the condition of the electrical connector terminals which connect the cables are difficult to monitor.

In the conventional art, rectangular connectors have been used to mate a matrix pattern of electrical pin contacts with a matrix pattern of electrical contact sockets. Chamfered mating edges insure easy polarized alignment of rectangularly shaped electrical connectors. However, rectangular connectors rely primarily on friction coupling to support the electrical contact. This method of coupling may only be used where the connector halves will not be subjected to any vibrations or movement, or where they will be under no undue strain or pressure. Therefore, in the aircraft environment, subject to considerable moisture and vibration, rectangular coupling arrangements may not be satisfactory.

Circular connectors are highly desirable for use in the aircraft environments. Standard screw thread couplings have been used which have a coupling nut collaring an electrical plug. The plug coupling nut is then screwed onto an electrical receptacle shell. But, such conventional screw threads require numerous turns to fully mate the plug and receptacle shells, and safety wiring of the coupling nut is required for secure mating. Acme-threaded couplings (of a high or zero pitch variety), as disclosed in U.S. Patent No. RE 31,462 to McCormick (original U.S. Pat. No. 3,848,950) reduce the number of threadings required when compared with the standard thread coupling. However, both the Acme-threaded coupling and the standard screw thread do not provide as quick a decoupling mechanism as is necessary in an aircraft environment.

An attempt to improve upon the Acme-threaded connector coupling is disclosed in U.S. Pat. No. 3,750,087 to Vetter. This patent discloses a detent ball on the receptacle shell which rides the bayonet groove in the coupling nut mechanism of a plug connector. As one turns the coupling nut to lock the connector plug into the receptacle shell, the detent ball advances along a bayonet groove until it locks in a detent. A wave spring washer maintains pressure to assure ball/detent lock. This method of coupling, although representing an improvement, provides a preloaded stress to the spring washer which it may not be able to withstand under all conditions.

U.S. Pat. No. 4,056,298 to Cooper discloses a flanged retainer ring which is in abutment within the walls of a coupling ring housing in such a manner that the ring is rotated 90 degrees along the circumference of the inner diameter of the coupling ring housing and then translated axially forward to lock as a breach lock, into a fixed position when the connector is fully mated. FIGS. 22 through 25 of this Cooper patent clearly illustrate this breach lock feature. This coupling arrangement requires only a partial rotation of the coupling nut to lock the electrical connector assembly into a fully mated condition. However, this coupling is dependent upon the strength of helical spring 91 pressing the retainer ring 92 forward in abutment with the inner diameter of the coupling ring housing 71. In a severe mechanical vibrational environment, such as is common in aircraft, this breach lock arrangement may uncouple.

An attempt to supplement this design is suggested in U.S. Pat. No. 4,277,125 to Ball. In this patent, there is disclosed an arcuate detent member, U-shaped in design, having extended convex surfaces forming a pair of dog legs for insertion radially within a detent recess. With reference to FIG. 7 of the Ball patent, as one rotates the coupling nut, through 90 degrees, the detent member causes the connector to latch at a fully open and fully mated position. Like the breach lock of the Cooper patent, this Ball patent has a breach lock mechanism for securing the coupling of the electrical connector plug to the receptacle shell. This arcuate detent, wishbone in shape, under extreme mechanical vibration may break or fracture, giving rise to a "wounded" dog leg which could obstruct the detent groove and prevent rotation of the coupling nut.

Although circular connectors provide a stronger and more vibration-resistant coupling than rectangular connectors, they require some form of polarization, so that as the coupling draws the electrical connector plug into the connector receptacle, the matrix pattern of pins and sockets will be in proper alignment.

The conventional art of the Vetter patent also discloses a mechanism having fixed bayonet pins protruding radially outwardly from the collar of a receptacle shell. The connector shell is telescoped within the receptacle shell, while a coupling ring is rotated which surrounds the connector shell in order to advance the connector shell forward into a fully mated position. As the coupling ring is turned, the fixed bayonet pins ride a helical bayonet groove scored along the inner diameter of the coupling ring. The terminals of the bayonet grooves are orifices which accommodate the securement of the bayonet pins of the receptacle into the coupling ring. This locking mechanism represents an improvement over other forms of connector coupling systems, but the fixed bayonet design may not have sufficient flexibility for reliable coupling under conditions of mechanical stress or vibration. For example, if the fixed bayonet pin becomes bent, it may no longer ride the bayonet groove properly and thereby prevent necessary coupling or decoupling of electrical connections within an aircraft.

What is needed is a coupling mechanism which provides the advantages of the previously described bayonet groove coupling in a more reliable manner.

Furthermore, when an electrical connector plug is attached to the free end of a cable, for quick coupling and decoupling with a fixed or mounted circular receptacle shell, it is important that the polarization system, within the plug, for directing the alignment of the plug and receptacle is preserved. Heretofore, no design previously known to the inventors has been directed to solving the problem of the inadvertent misalignment of the electical connector plug assembly, when that assembly is not fully mated to an electrical connector receptacle shell. As noted earlier, the receptacle shell may have a polarization key or keyway for accommodating a properly aligned electrical connector plug for mating. Since a coupling ring or nut provides quick and useful leverage for securing the mechanical coupling of connector receptacles and plugs, it is necessary to make certain that the initial position of the coupling ring and the connector shell of the electrical connector plugs are in proper alignment before an attempt is made to mate this assembly with an electrical receptacle shell. Heretofore, aircraft mechanics, unfamiliar with the detailed operation of complex electrical plug assemblies, have inadvertently (usually through release of the compression retainer ring apparatus housed at the rear of an electrical connector plug assembly) placed the coupling ring or nut out of alignment with the connector shell. When this technician later attempted to mate a misaligned electrical plug with an electrical receptacle shell, he found that he was unable to do so. What is needed is a mechanism housed within the electrical connector plug assembly which would prevent the inadvertent misalignment of the coupling ring or housing with the connector shell of the electrical connector plug. Such a mechanism could lock the polarization and alignment of the electrical connector plug assembly except when the plug has been placed in position for fully mating with the electrical connector receptacle.

The invention disclosed herein is an improved design which presents, in combination, an improved bayonet grooved coupling mechanism with a mechanism for preventing misalignment of components within the electrical plug assembly prior to mating with a receptacle shell.

SUMMARY OF THE INVENTION

The present invention is an electrical connector plug assembly for mating with an electrical receptacle shell assembly in order to achieve electrical contact between a matrix of electrical pins or sockets engageable with a corresponding matrix of complementary pins or sockets. The electrical plug connector assembly is capable of quick connection and release from the receptacle shell assembly and has a floating bayonet roller bearing pin assembly in order to reliably engage the electrical connector plug assembly with the receptacle shell.

The floating bayonet coupling mechanism comprises a drive sleeve which is telescoped through a system of equally spaced keys and key ways within the coupling nut so that when the coupling nut is rotated by an external torque, the drive sleeve and coupling nut rotate together. Disposed within the drive sleeve band are a plurality of evenly spaced floating cylindrically shaped bayonet pins disposed within evenly spaced apertures defined along the circumference of the drive sleeve. The bayonet pins ride along the outer surface of the connector plug shell within helically grooved annular guide ways. As the pins move within the surface of the guide ways when the coupling nut and drive sleeve assemblies are rotated, the connector plug shell, being integrally affixed to the helically guide ways, moves along in an axial direction causing the connector plug shell to quickly and smoothly mate with the receptacle shell. The connector shell and coupling nut assembly are normally biased towards the receptacle shell. Notches or key ways are sculptured into the innner diameter of the connector plug shell and coupling nut.

When the electrical connector plug is not mated to the receptacle shell, but simply attached to one end of a cable, the component parts of the connector plug assembly including the coupling nut and the connector plug shell must remain in proper alignment if the electrical plug assembly is to be mated onto the receptacle shell.

An anti-rotation, spring-loaded, latch mechanism is provided to prevent misalignment of the component parts of the electrical connector plug assembly when the electrical plug is not mated to the receptacle shell. The anti-rotation latch is seated within the lower receptacle receiving rim of the electrical connector plug shell. This latch is pivotally mounted and spring biased to engage and break the drive sleeve to prevent the drive sleeve from rotating relative to the connector plug shell. The anti-rotation latch has a rounded cam surface along its anterior side, so that when the connector shell begins to mount the receptacle shell, the end collar of the receptacle shell abuts the cam surface of the anti-rotation latch mechanism, causing the latch to pivot in a rotational direction which removes the lower latch leg from the drive sleeve, thereby releasing the drive sleeve for rotational movement about the outer surface of the connector plug shell. When the connector plug shell begins to dismount from the receptacle shell, the spring biased lower latch leg re-engages the drive sleeve to prevent the drive sleeve from rotating relative to the connector plug shell. As the receptacle shell is pushed deep into the body of the connector shell, an axially disposed polarization land positioned atop the connector shell, guides the connector shell into proper alignment along the receptacle shell surface until the electrical plug assembly abuts the wall plate of the receptacle shell. As the plug coupling nut meets the wall plate of the receptacle shell, an audible click is produced, signalling instructions to begin the rotation of the coupling nut to breech lock the plug assembly to the receptacle shell.

The drive sleeve of the coupling nut, while rotating about the outer circumference of the connector plug shell, moves the connector plug shell forward until bayonet pins mounted within the drive sleeve and travelling along the helical guide ways of the outer surface of the connector shell reach their respective terminal points and locks in the detents provided, thereby securing the bayonet pin in a breach lock position for secure coupling of the electrical connector plug assembly to the receptacle shell.

DETAILED DESCRIPTION OF THE PREFERRED EMBODIMENT

Figure 1:
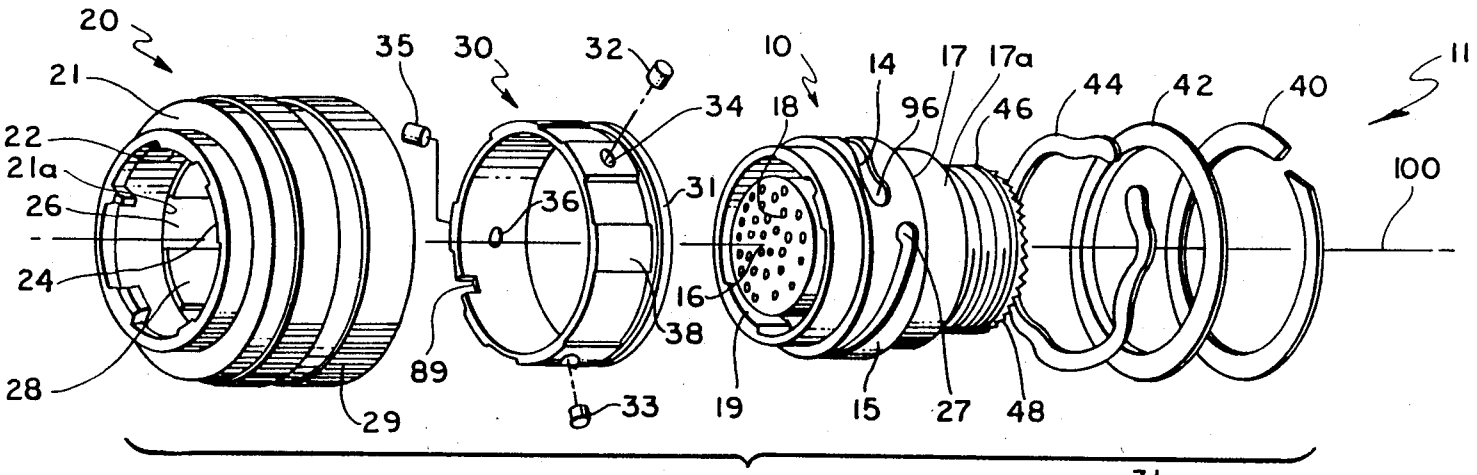
FIG. 1 is an exploded perspective view of the electrical connector plug assembly of the preferred embodiment of this invention.
Figure 2:
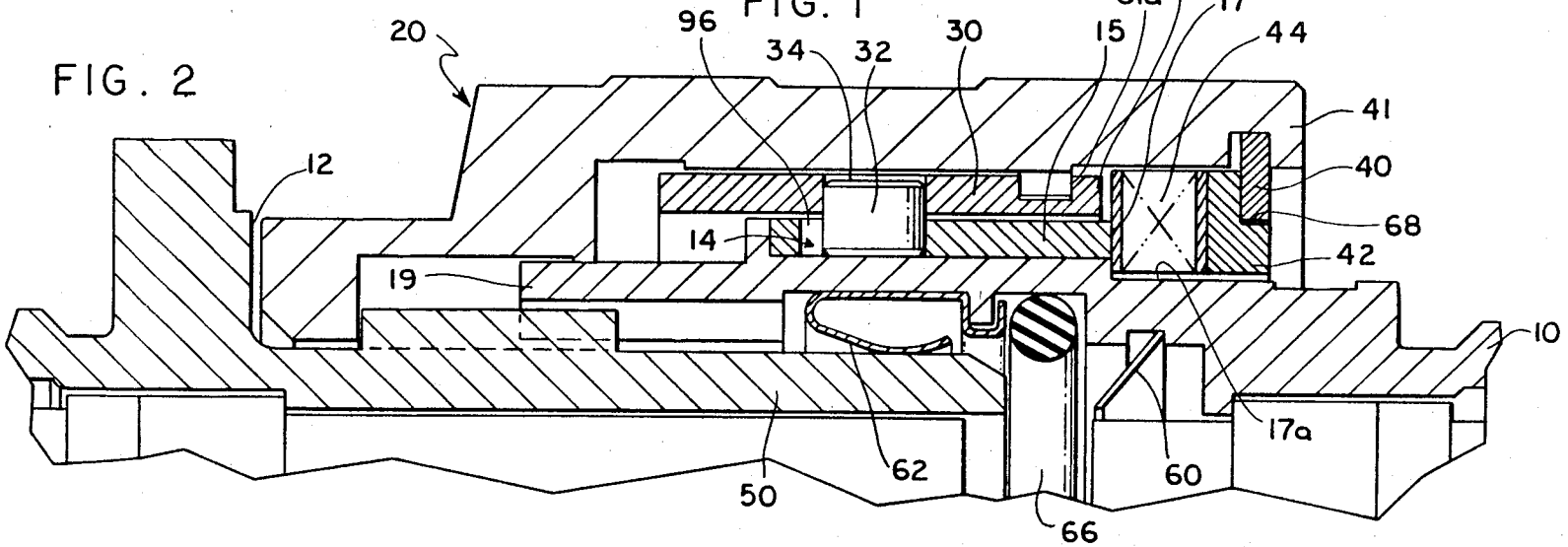
FIG. 2 is a cross-sectional partially fragmented view of the electrical connector assembly showing the electrical plug connector partially mated with the electrical receptacle connector shell.

With reference to FIGS. 1 and 2, a circular electrical connector plug assembly is shown generally at 11. The assembly of this invention comprises an electrical connector shell, shown generally as 10, telescoped within a coupling nut 20. In the preferred embodiment, a drive sleeve 30, axially disposed around the insert barrel 19 of the connector shell 10 rides the axially extending shouldered band 15 which is integral with the outer surface of the insert barrel 19 of the connector shell 10. The shell 10, coupling nut 20 and drive sleeve 30 define a center axis 100 for the connector assembly. Disposed axially at one end of the connector shell 10 is the serrated connector shell edge 48. A helical annular groove 46 surrounds the outer surface of the insert barrel 19 of the connector shell 10 between the serrated shell edge 48 and the shouldered band 15. An insert insulator 16 perforated with a matrix 18 of electrical contact-receiving holes, is made from an insulating material and seated axially disposed within the confines of the insert barrel 19 of the connector shell 10. The wave spring 44 is normally seated around a cylindrical surface 17*a* of the connector shell 10. Pressing against the wave spring 44 and also seated surrounding the surface 17*a* are the washer 42 and the retaining ring 40. The wave spring 44, the washer 42, and the retaining ring 40 conventionally apply a compressive prestressing load axially against a second shoulder 17 between the surface 17*a* and the shoulder band 15 biasing the connector shell 10 forward toward the inner surface 21*a* of the first shoulder 21 of the coupling nut 20.

The drive sleeve 30 locks into the inner diameter of coupling nut 20 by keying into an alternating series of sleeve receiving key-ways 26 and sleeve receiving keys 28. The key-ways 26 and the keys 28 are complimented by a matching set of drive sleeve keys 38 and a matching set of drive sleeve key-ways 39, respectively, as the drive sleeve 30 is positioned and moved axially, into the inner diameter of the coupling nut 20. The drive sleeve shoulder 31 abuts against an inner diameter shoulder 31*a* of the sleeve receiving key 28 of the coupling nut 20, so that the drive sleeve 30 is keyed securely in abutting alignment within the coupling nut 20. In such a manner, after the drive sleeve 30 is keyed within the coupling nut 20, the drive sleeve 30 and the coupling nut 20 rotate about the central axis of the coupling nut as a unitary structure when an external torque is applied to the coupling nut knurl 29. Placed at a plurality of locations along the drive sleeve 30 are the bearing receiving apertures 34. The roller bearings 32, 33, and 35, are generally cylindrically shaped bearings which are placed within the bearing receiving apertures 34 so as to rotate within the apertures 34. Before placing the drive sleeve 30 within the key ways 26 and keys 28 of the inner diameter of the coupling nut, the roller bearings 32, 33, and 35 are positioned within the apertures 34, and the connector shell 10 is telescoped within the drive sleeve 30 so that the drive sleeve 30 surrounds the shouldered band 15 of the insert barrel 19 of the connector shell 10.

When the drive sleeve 30 is placed in position about the shouldered band 15 of the barrel 19, each of the roller bearings 32, 33, and 35 are positioned in alignment and within a separate bayonet coupling guideway 14. Each guideway is sculptured into the surface of the shouldered band 15 of the barrel 19. Once the roller bearings 32, 33, and 35 are each positioned within their respective bayonet coupling guideways, the drive sleeve 30 may be rotated about the shouldered band 15 within an approximate 90 degrees span of rotation. Each roller bearings 32, 33, and 35 have the freedom to travel within its bayonet coupling guideways from an initial terminus, such as initial terminus 96, to a final terminus 27 located one-quarter of a rotation radially along the circumference of the shouldered band of the barrel 19 within the bayonet coupling guideway 14. The bayonet coupling guideways 14 are each pitched in a helical pattern so that as the roller bearings 32, 33, and 35 move within their respective bayonet coupling guideways, the connector shell 10 is translated axially forward along the inner wall of the drive sleeve 30 and into the coupling nut 20. When an outside torque is applied to the knurl 29 about the outer diameter of the coupling nut 20, the coupling nut 20 will draw the connector shell 10 forward towards the front rim 22 of the coupling nut 20 into the inner diameter barrel of the coupling nut 20. In this manner, mating of contacts seated within the insulator 16 of the connector shell 10 and, the insulator matrix seated within the receptacle shell 50 can occur.

Figure 3:
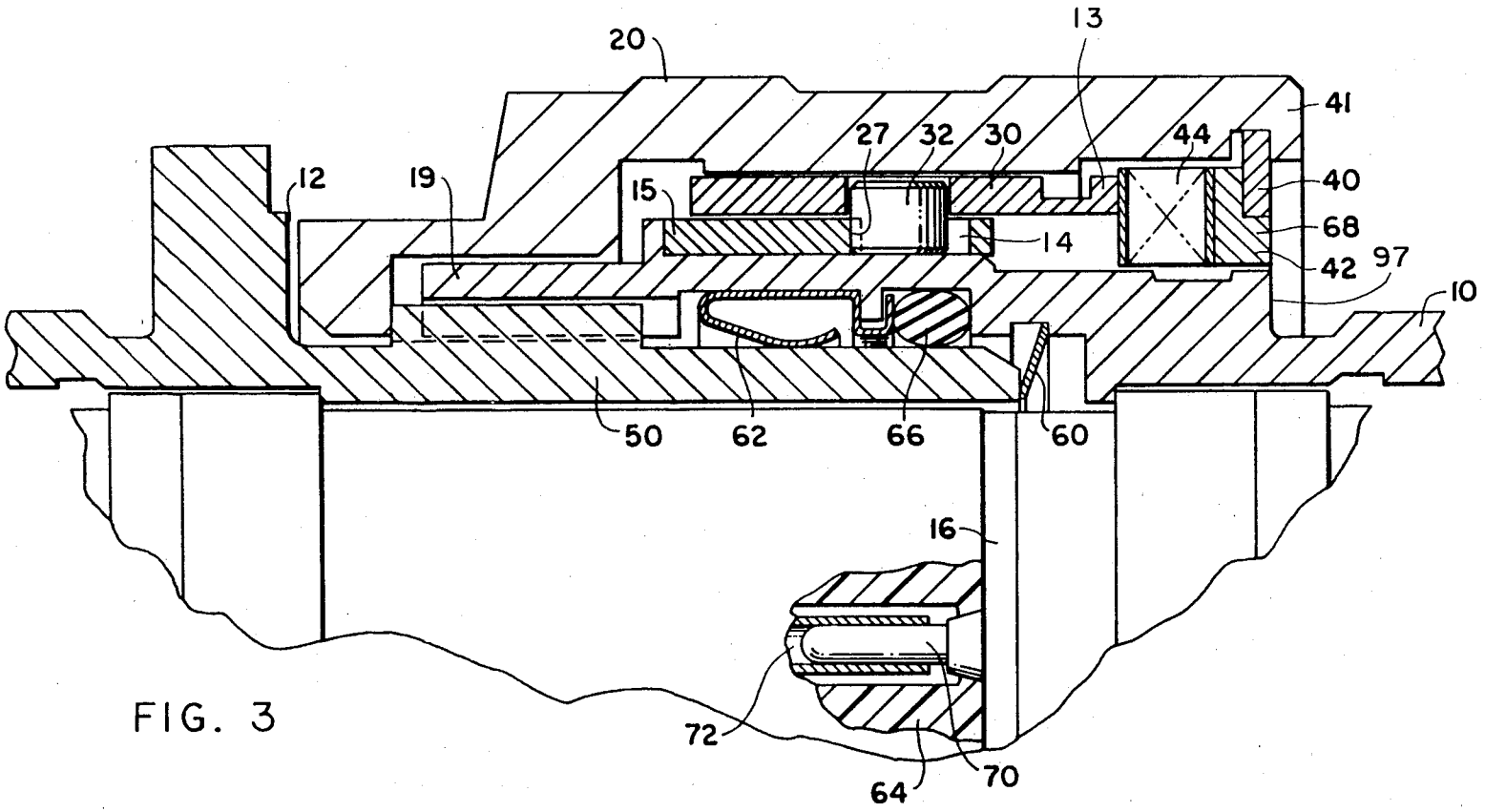
FIG. 3 is a cross-sectional partially fragmented view of the electrical connector assembly showing the electrical plug connector fully mated with the electrical receptacle connector shell.

To further illustrate the operational characteristics of the electrical connector assembly of this invention, FIGS. 2 and 3 show the contrasting operational positioning of the parts of the electrical connector assembly when the connector plug assembly is first placed in contact with the receptacle shell 50 and after the plug assembly 11 is pushed into fully mated position against the receptacle shell wall plate 12 of the receptacle shell 50. For purposes of illustration, and as is conventionally the case, the receptacle shell 50 may be visualized as being a stationary projection, connected to and protruding forward from an instrument control panel of an electrical apparatus which may be commonly aboard an aircraft. It should be noted that although not shown in FIGS. 1 or 5, the receptacle shell 50 has telescoped within its inner diameter an insert insulator which is complimentary to the insulator 16 of the connector shell 10. Because the receptacle 50 is generally a stationary object within the electrical connector assembly, it is so designated, while the connector plug assembly 11, illustrated in FIG. 1, is generally connected to one end of a moveable cable. However, depending on the application, the matrix 18 of connector holes of insulator 16 of the connector shell 10 contain either electrical socket contacts or electrical pin contacts. Likewise, the insulator seated within the receptacle 50 is not restricted to supporting electrical socket contacts, but may have matrix pin contacts for insertion into socket contacts within the electrical plug assembly 11. For illustrative purposes, FIG. 3 shows the insulator 64 of the receptacle 50 containing a representative socket contact 72 for receiving a representative pin contact 70 of the connector plug assembly 11. The pin contact 70 projects forward from the insulator 16 disposed within the connector shell 10.

As previously noted hereinabove, FIG. 2 shows the coupling nut 20 forward within the connector plug 11 assembly partially mating onto the surface of the receptacle shell 50. FIG. 2 shows a cross-section of the wave spring 44 fully extended axially and the retainer ring 40 pushed axially against the rearward ring supporting inner diameter shoulder of the coupling nut 20, seated on the ledge 68 of the washer 42. The wave spring 44, the washer 42, and retainer ring 40 provide, in a conventional manner, a positioning bias urging the connector shell 10 toward the receptacle 50 within the inner diameter body of the coupling nut 20. The cross-sectional view of FIG. 2 also shows the positioning of the EMI ring 60, the RFI spring 62, and the O-ring 66, all in a relaxed pre-mating condition. The roller bearing 32 is shown seated within the bayonet coupling guideway 14 positioned within an initial terminus point 96 of the guideway 14. Turning to FIG. 3, as the connector shell insert barrel 19 moves forward along the receptacle shell 50, the O-ring 66, in cross-section, is deformed to an elliptical shape as it is fitted snugly within its seat below the connector shell insert barrel 19 and against the RFI spring 62. The EMI ring 60 also moves forward to a more radially extended direction as the connector plug 11 becomes fully mated to the receptacle 50. FIG. 3 reveals that as the coupling nut 20 is rotated together with the drive sleeve 30 in order to move the connector shell 10 towards the wall plate 12 of the receptacle 50, the roller bearings 32, 33, and 35 move towards the rearward ring support shoulder 41 of the coupling nut 20 as the roller bearings move within the bayonet coupling guideway 14 of the drive sleeve 30 to the final terminus points 27 within the guideway 14. In such a manner, the roller bearings 32, 33, and 35 are able to rotate and float for a smoother connection between the coupling nut 20 and the connector shell 10 than has previously been the case in the conventional art.

Figure 4:
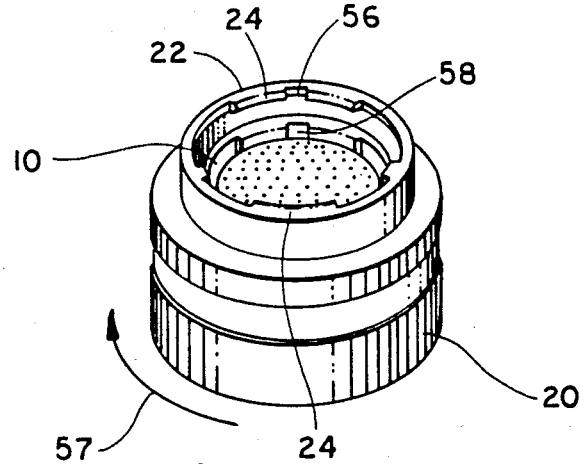
FIG. 4 shows a perspective view of the plug connector shell positioned within the coupling nut, both components in polarized alignment.
Figure 5:
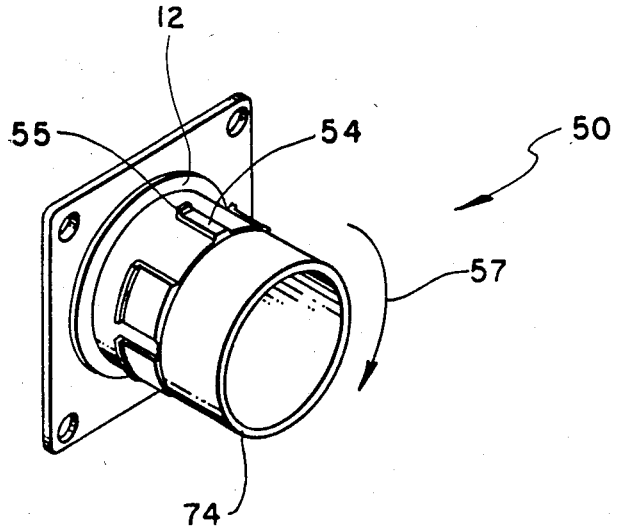
FIG. 5 shows a perspective view of the receptacle shell, highlighting the polarization land.

Turning to FIG. 4, the connector shell 10 is shown telescoped within the coupling nut 20. It should be noted that the outer polarization notch 56 of the coupling nut 20 is in precise alignment with the inner polarization notch 58 of connector shell 10. The lands and grooves 24 of the coupling nut 20, the connector shell 10, and the aligned polarization notches 56 and 58, serve to properly mate the entire connector plug assembly 11 onto the receptacle shell 50. With reference to FIG. 5, the radially flanged axially disposed polarization land 54 keys into notch 56 of coupling nut 20 with the inner polarization notch 58 of connector shell 10. It is only when the polarization notches 56 and 58 are in precise alignment that the land 54 is able to travel its complete length into the interior diameter of the connector shell 10. The receptacle shell wall plate 12 provides an audible click when the land 54 completely travels through the polarization notches 56 and 58 by hitting the front rim of the coupling nut 22 as the connector plug 11 fully mates with the receptacle shell 50. Once the connector plug assembly 11 is fully mated with the receptacle shell 50, an external torque applied to the knurl 29 of the coupling nut 20 rotates the coupling nut in a clockwise direction as illustrated by the torque arrow 57 of FIG. 5. When the coupling 20 is rotated, the internal drive sleeve 30 locked to the coupling nut 20 draws the rollers 32, 33 and 35 within the guideway 14 to move the connector shell 10 forward along the collar 74 of the receptacle shell 50.

With reference to FIG. 3, as the connector shell 10 moves forward, the contact pins 70, disposed in a matrix about the surface of the insulator 16, move forward into position within the socket contacts 72 of the insulator 64. The polarization land 54, working in cooperation with the polarization notches 56 and 58, functions to assure that each pin 70 matches its proper counterpart socket contact 72, since the land 54 orients the circular plug assembly 11 to mate with the receptacle 50 in only one way.

As noted in the discussion of the background of this invention, one of the difficulties which has occurred is that prior to mating on to the receptacle 50, the connector plug 11, attached to the end of a disconnected cable may be inadvertently tampered with so that, even when the plug 11 is not fully mated with the receptacle 50, one may rotate the connector shell 10 with respect to the coupling nut 20, thereby placing the outer polarization notch 56 of the coupling nut 20 out of alignment with the inner polarization notch 58 of the connector shell 10.

Figure 6:
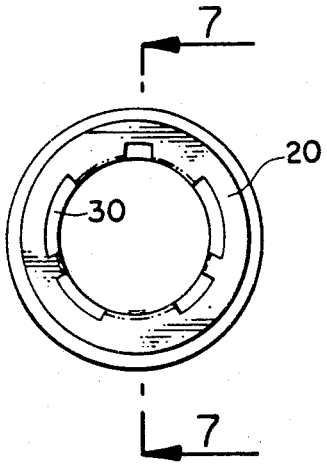
FIG. 6 is a plan view of FIG. 4 with the insulator insert removed for illustrative purposes, showing the connector plug shell, drive sleeve, and coupling nut.

Turning to FIG. 6, for illustrative purposes, drive sleeve 30 and connector shell 10 are shown keyed and telescoped within the coupling nut 20. The insulator insert 16 has been removed from within the connector shell 10 for ease of illustration.

Figure 7:
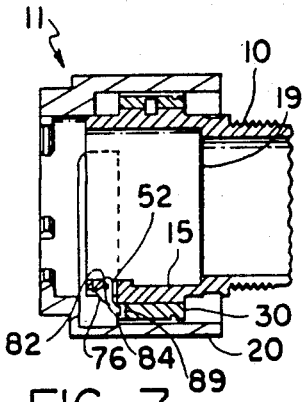
FIG. 7 is a cross-sectional view taken along line 7—7 of FIG. 6, showing an alternative embodiment of this invention illustrative of the anti-rotation mechanism.
Figure 8:
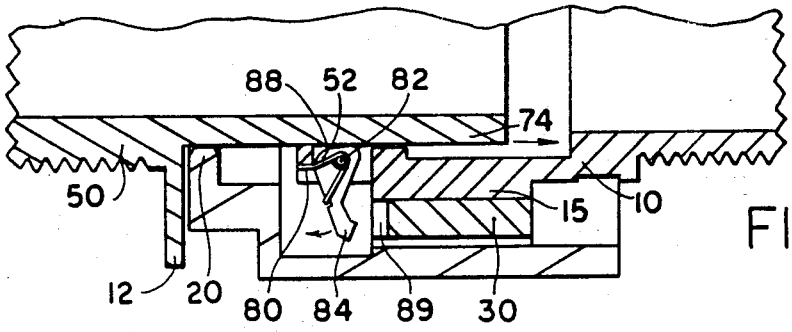
FIG. 8 is a partially fragmented and enlarged cross-sectional view, as in FIG. 7, but showing the collar of the receptacle shell fully mating with the electrical connector plug assembly and anti-rotation latch mechanism in the unlocked position.

Turning to cross-sectional view FIG. 7, drive sleeve 30 is shown to be keyed within the inner diameter of coupling nut 20. Drive sleeve 30 is abutted against shoulder band 15 of insert barrel 19. Seated securely within an aperture 76 is the anti-rotation latch 52. It should be noted that the leg 84 of the latch 52 is positioned for engaging with the forward notch 89 of the drive sleeve 30. Referring briefly to FIG. 8, it can be noted that a wire spring 80 may be used to bias the anti-rotation latch 52 counterclockwise as shown in FIGS. 7 and 8, to push the latch leg 84 forward into the notch 89 of the drive sleeve 30, thereby preventing rotation of the drive sleeve 30 or the coupling nut 20 when the receptacle shell 50 is not inserted. FIG. 7 is illustrative of the position of the anti-rotation mechanism when the electrical plug assembly 11 is attached to the unconnected end of a loose cable.

FIG. 8 illustrates the method for deactivation of the anti-rotation mechanism. When the electrical connector plug 11 is mated to the receptacle shell 50, the end collar 74 of the receptacle shell 50 slides adjacent to the inner diameter of the connector shell 10, sliding against the cam surface 88 of the anti-rotation latch 52. As the end collar 74 is pushed into full mating position within the electrical connector 10, the forward axial movement of the collar 74 causes the latch 52 to rotate clockwise (as illustrated) thereby releasing the leg 84 of the latch 52 from the forward notch 89 of the drive sleeve 30. Once fully mated, the anti-rotation latch 52 is prevented from prohibiting rotation of the drive sleeve 30 and hence the coupling nut 20, relative to the connector shell 10. The electrical plug connector is now ready to be fully mated as previously described.

Figure 9:
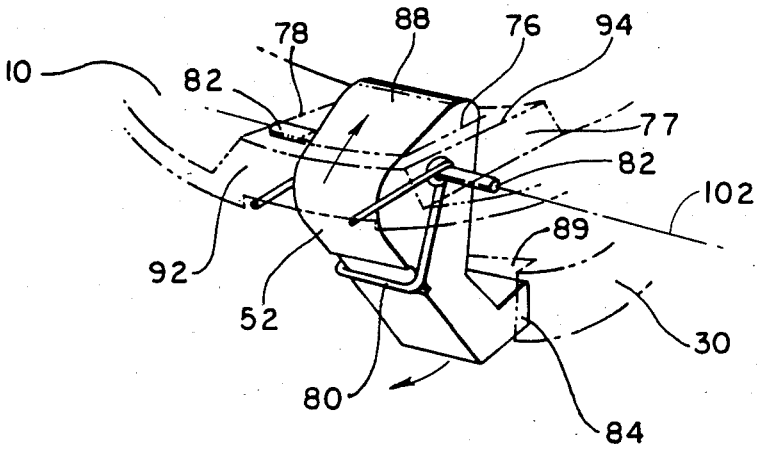
FIG. 9 is an enlarged partially exploded perspective view of the anti-rotation latch mechanism secured within its housing, at the rim (in phantom) of the connector shell.

Turning to FIG. 9, there is illustrated, an enlarged view of the anti-rotation latch 52. Pivot pin 82 defines a pin axis 102 transverse to the center axis 100 (FIG. 1). The pivot pin 82 is securely seated tangential to the circumference of the lower rim 92 of the connector shell 10.

An aperture 76 is provided for placement of the anti-rotation latch 52. The pivot pin 82 is seated fixed and secure within seats 78 and 77, shown in phantom. The wire formed spring 80 is designed to bias the anti-rotation mechanism inward toward the forward drive sleeve notch 89 of drive sleeve 30. In this manner, an anti-rotation mechanism is provided which will prevent rotation of polarization notches 56 and 58 out of alignment when the electrical connector plug assembly 11 is disengaged from the receptacle shell 50. Only when the connector plug assembly 11 is ready for secure mating to the receptacle shell 50, does the collar 74 of receptacle 50 operate to disengage the anti-rotation latch mechanism 52, releasing drive sleeve 30 to rotate and move the roller bearings 32, 33, and 35 along the bayonet coupling guideways 14 as shown in FIG. 1.

The operation of the drive sleeve 30 pulling the roller bearings 32, 33, and 35 along the bayonet coupling guideway 14 of the shouldered band 15 of the insert barrel 19 is an improved and smoothly operating breach lock. Unlike the fixed bayonet pin of the conventional art moving along helically disposed grooves within a coupling ring, the floating roller bearings 32, 33, and 35 provide a firm metal to metal coupling between constituent components of the connector plug assembly 11 while assuring a smooth rotation of the fitting between the drive sleeve 30 and the shouldered band 15 of the insert barrel 19. The operation of this improved bayonet groove coupling mechanism together with the anti-rotation latch 52 disclosed herein, combine to produce an electrical connector assembly of a reliable and improved design.

It should be noted that the preferred embodiment is merely illustrative of an improved electrical connector assembly. The scope of the invention is not necessarily limited to the preferred embodiment. Structural changes may be possible, and those changes are intended to be within the scope of this disclosure. For example, the anti-latch mechanism may be made to operate with the use of a leaf spring rather than a latch affixed to a wire formed spring. As the receptacle shell passes over that part of the electrical connector shell housing the leaf spring mechanism, this leaf spring could shift radially outward, releasing the drive sleeve for movement with respect to the connector shell. Consequently, this specific structural and functional details of the electrical connector assembly are merely representative, yet they are deemed to afford the best embodiment for purposes of disclosure and for providing support for the claims which define the scope of the present invention.

What is claimed is:

1. An electrical connector assembly having a first member with a matrix of holes and a second member with a matrix of pins for being pressed into the matrix of holes, the connector aassembly comprising:

a cylindrical first shell defining a cylindrical passageway extending axially therethrough;

a shoulder band extending around the first shell, the shoulder band having disposed thereinto at least one helically shaped guideway;

a cylindrical drive sleeve having at least one cylindrical orifice extending radially therethrough, each cylindrical orifice radially aligned with one of the guideways;

a cylindrical roller rotatably positioned in each cylindrical orifice for extending through the orifice into engagement with the aligned guideway whereby rotational movement of the drive sleeve relative to the first shell causes the rollers to roll along the helical guideway for causing relative axial movement between the drive sleeve and the first shell for pressing the matrix of pins into the matrix of holes with increased mechanical advantage;

a coupling nut rotatably mated with the drive sleeve for causing the drive sleeve and coupling nut to rotate together;

a cylindrical second shell for insertion into the passageway of the first shell;

alignment means for aligning the drive sleeve and the first shell in a predefined fixed rotational orientation relative to each other when the second shell is not inserted relationship in the passageway, but enabling rotation of the drive sleeve relative to the first shell out of the predefined fixed rotational orientation when the second shell is positioned in the passageway.

2. The connector assembly of claim 1 wherein each helical guideway has a final terminus region, the coupling nut and drive sleeve being rotatable together between a fully disengaged position and a fully engaged position only when the second shell is positioned in the passageway, the connector assembly further comprising:

means for urging the rollers into and maintaining the rollers in the final terminus regions upon rotation of the drive sleeve relative to the first shell into the fully engaged position.

3. The connector assembly of claim 2 wherein the drive sleeve has a first annular end and a second annular end opposite the first annular end and the urging means comprises a wave spring Positioned between the coupling nut and the first end of the drive sleeve for urging the drive sleeve and consequently the rollers into, and keeping the rollers in, the final terminus region, the coupling nut being inhibited from rotating when the roller is in the final terminus region.

4. The connector assembly of claim 1 wherein each helical guideway has an initial terminus region, the coupling nut and drive sleeve being rotatable between a fully engaged position and a fully disengaged position when the shell is positioned in the passageway, the connector assembly further comprising:

means for urging the rollers into, and maintaining the rollers in, the initial terminus region upon the rotation of the drive sleeve relative to the first shell into a fully disengaged position.

5. The connector assembly of claim 1 wherein the rollers are freely radially moveable within the cylindrical orifices through the drive sleeve.

6. The electrical connector assembly of claim 1 wherein the drive sleeve comprises a first annular end and a second annular end opposite the first end, the drive sleeve having a notch disposed in the second end at a predefined location about the circumference of the second end; and wherein the first shell defines a center axis and has a latch mount opening therethrough, the opening being axially positioned for being adjacent the notch in the drive sleeve and being circumferentially positioned to cooperate with the coupling nut whereby the coupling nut and the first shell are positioned in a preselected rotational alignment with each other when the notch is in alignment with the latch opening, the alignment means comprising:

a pivot pin mounted to the first shell across the latch mount opening transverse to the center axis;

a latch member pivotally mounted to the pivot pin to pivot thereabout the latch member positioned in the latch mount opening, the latch member having:

a leg part extending from the latch mount opening and positioned for engaging the notch and preventing relative rotation between the drive sleeve and the first shell, and a cam part extending from the opening into the passageway and positioned for being engaged by the second shell for pivoting the leg part out of engagement in the notch, and spring means coupled to the latch member for biasing rotation of the leg part into engagement in the notch.

7. An electrical connector assembly comprising:

a first shell having an axial passageway therethrough and having a radially disposed latch mount opening therethrough;

a second shell for being selectively mated with the first shell;

a drive sleeve cylinder rotatably mounted on the first shell, the drive sleeve having an annular first end with a notch therein, the notch positioned to cooperate with the latch mount opening to selectively, annularly align the drive sleeve and the first shell when the notch and latch mount opening are aligned;

a pivot pin mounted to the first shell across the latch mount opening transverse to the center axis;

a latch member pivotably mounted to the pivot pin and positioned in the latch mount opening, and latch member having:

a leg part extending from the latch mount opening and positioned for engaging the notch and preventing relative rotation between the drive sleeve and the first shell, and a cam part extending from the opening into the passageway and positioned for being engaged by the second shell when the second shell is inserted into the passageway for pivoting the leg part out of engagement with the notch to enable rotation of the drive sleeve on the first shell; and spring means coupled to the latch member for biasing rotation of the leg part into engagement in the notch.

* * * * *